US007348937B2

(12) United States Patent
Tachibana et al.

(10) Patent No.: US 7,348,937 B2
(45) **Date of Patent: *Mar. 25, 2008**

(54) PLASMA DISPLAY PANEL DRIVE METHOD

(75) Inventors: Hiroyuki Tachibana, Osaka (JP); Jumpei Hashiguchi, Kyoto (JP); Kenji Ogawa, Osaka (JP); Toshikazu Wakabayashi, Osaka (JP); Tomohiro Murakoso, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 217 days.

This patent is subject to a terminal disclaimer.

(21) Appl. No.: 10/546,991

(22) PCT Filed: Feb. 23, 2005

(86) PCT No.: PCT/JP2005/002865

§ 371 (c)(1),
(2), (4) Date: Aug. 26, 2005

(87) PCT Pub. No.: WO2005/086129

PCT Pub. Date: Sep. 15, 2005

(65) Prior Publication Data

US 2006/0164338 A1 Jul. 27, 2006

(30) Foreign Application Priority Data

Mar. 8, 2004 (JP) ..... 2004-063556

(51) Int. Cl.
*G09G 3/28* (2006.01)

(52) U.S. Cl. ..... 345/60; 345/62; 345/63; 345/66

(58) Field of Classification Search ..... 345/60–69, 345/90–99; 315/169.1–169.4
See application file for complete search history.

(56) References Cited

U.S. PATENT DOCUMENTS

| | | | | |
|---|---|---|---|---|
| 2005/0215159 | A1* | 9/2005 | Yamauchi et al. | 445/6 |
| 2006/0284795 | A1* | 12/2006 | Akiyama et al. | 345/60 |
| 2006/0284796 | A1* | 12/2006 | Kigo et al. | 345/60 |

FOREIGN PATENT DOCUMENTS

| | | |
|---|---|---|
| JP | 8-162026 | 6/1996 |
| JP | 9-160525 | 6/1997 |
| JP | 9-319328 | 12/1997 |
| JP | 10-39834 | 2/1998 |
| JP | 10-63222 | 3/1998 |
| JP | 2002-150949 | 5/2002 |
| JP | 2004-29412 | 1/2004 |

* cited by examiner

*Primary Examiner*—Vijay Shankar
(74) *Attorney, Agent, or Firm*—Wenderoth, Lind & Ponack, L.L.P.

(57) ABSTRACT

Barrier ribs are disposed on a back substrate so as to separate main discharge cells and priming discharge cells, and the top parts of the barrier ribs are formed so as to abut on a front substrate. In a driving method, in an odd-numbered line writing time period, scan pulse Va is sequentially applied to odd-numbered scan electrode $SC_p$ and voltage Vq is applied to even-numbered sustain electrode $SU_{p+1}$ to cause priming discharge between even-numbered sustain electrode $SU_{p+1}$ and odd-numbered scan electrode $SC_p$. In an even-numbered line writing time period, scan pulse Va is sequentially applied to even-numbered scan electrode $SC_{p+1}$ and voltage Vq is applied to odd-numbered sustain electrode $SU_p$ to cause priming discharge between odd-numbered sustain electrode $SU_p$ and even-numbered scan electrode $SC_{p+1}$.

1 Claim, 5 Drawing Sheets

PLASMA DISPLAY PANEL DRIVE METHOD

TECHNICAL FIELD

The present invention relates to a driving method of a plasma display panel used in a wall-mounted television (TV) or a large monitor.

BACKGROUND ART

A plasma display panel (hereinafter referred to as "PDP" or "panel") is a display device that has a large screen, is thin and light, and has high visibility.

A typical alternating-current surface discharge type panel used as the PDP has many discharge cells between a front plate and a back plate that are faced to each other. The front plate has the following elements:

- a plurality of pairs of display electrodes disposed in parallel on a front glass substrate; and
- a dielectric layer and a protective layer for covering the display electrode pairs.

Here, each display electrode is formed of a scan electrode and a sustain electrode. The back plate has the following elements:

- a plurality of data electrodes disposed in parallel on a back glass substrate;
- a dielectric layer for covering the data electrodes;
- a plurality of barrier ribs disposed on the dielectric layer in parallel with the data electrodes; and
- phosphor layers disposed on the surface of the dielectric layer and on side surfaces of the barrier ribs.

The front plate and back plate are faced to each other so that the display electrodes and the data electrodes three-dimensionally intersect, and are sealed. Discharge gas is filled into a discharge space in the sealed product. In the panel having this configuration, ultraviolet rays are emitted by gas discharge in each discharge cell. The ultraviolet rays excite respective phosphors of red (R), green (G), and blue (B), emit light, and thus provide color display.

A subfield method is generally used as a method of driving the panel. In this method, one field time period is divided into a plurality of subfields, and the subfields at which light is emitted are combined, thereby performing gradation display. Here, each subfield has an initialization time period, a writing time period, and a sustaining time period.

In the initialization time period, initializing discharge is performed simultaneously in all discharge cells, the history of the wall charge for each discharge cell before the initializing discharge is erased, and wall charge required for a subsequent writing operation is formed. Discharge delay is reduced, and priming (detonating agent for discharge=exciting particle) for stably causing writing discharge is generated. In the writing time period, a scan pulse is sequentially applied to the scan electrodes, a writing pulse corresponding to an image signal to be displayed are applied to the data electrodes, writing discharge is selectively raised between the scan electrodes and the data electrodes, and the wall charge is selectively generated. In the subsequent sustaining time period, a predetermined number of sustaining pulses are applied between the scan electrodes and the sustain electrodes, and discharge and light emission are performed selectively in the discharge cells where the wall charge is generated by writing discharge.

For displaying an image correctly, it is important to certainly perform the selective writing discharge in the writing time period. However, the writing discharge has many factors that increase the discharge delay. The factors are, for example, facts that high voltage cannot be used for the writing pulses because of constraints in circuit configuration or that the phosphor layers formed on the data electrodes suppress the discharge. Therefore, the priming for stably causing the writing discharge becomes extremely important.

However, the priming generated by the discharge rapidly decreases with the passage of time. In the driving method of the panel, in the writing discharge after a lapse of a long time since the initializing discharge, the priming generated by the initializing discharge disadvantageously comes short, thereby increasing the discharge delay, destabilizing the writing operation, and reducing the image display quality. When the writing time period is set long for stabilizing the writing operation, disadvantageously, the time taken for the writing time period excessively increases.

For addressing the problems, a panel for generating the priming using a priming discharge cell disposed on the front plate of the panel and reducing the discharge delay, and a driving method of the panel are disclosed (for example, Japanese Patent Unexamined Publication No. 2002-150949).

In this panel, however, adjacent discharge cells are apt to interfere with each other. Especially, in the writing time period, the priming generated by writing discharge of the adjacent discharge cells can cause a writing error or bad writing, and hence the driving voltage margin of a writing operation becomes narrow.

SUMMARY OF THE INVENTION

The present invention provides a driving method of a plasma display panel. The plasma display panel has the following elements:

- a first substrate;
- a plurality of display electrode pairs that are disposed on the first substrate and are formed of scan electrodes and sustain electrodes arranged in parallel;
- a second substrate faced to the first substrate through a discharge space;
- a plurality of data electrodes disposed on the second substrate in the direction crossing the display electrode pairs; and
- a barrier rib disposed between the first substrate and second substrate so as to separate main discharge cells for causing main discharge and priming discharge cells for causing priming discharge.

In this method, one field time period is formed of a plurality of subfields having an initialization time period, a writing time period, and a sustaining time period. The writing time period has an odd-numbered line writing time period and an even-numbered line writing time period. In the odd-numbered line writing time period, a writing operation is performed in the main discharge cell corresponding to an odd-numbered scan electrode, and in the even-numbered line writing time period, a writing operation is performed in the main discharge cell corresponding to an even-numbered scan electrode. In the odd-numbered line writing time period, a scan pulse is sequentially applied to an odd-numbered scan electrode, and voltage is applied to an even-numbered sustain electrode. This voltage is used for causing priming discharge in the priming discharge cell between the even-numbered sustain electrode and the odd-numbered scan electrode to which the scan pulse has been applied. In the even-numbered line writing time period, a scan pulse is sequentially applied to an even-numbered scan electrode, and voltage is applied to an odd-numbered sustain electrode. This voltage is used for causing priming discharge in the priming discharge cell between the odd-numbered sustain electrode and the even-numbered scan electrode to which the scan pulse has been applied. In the sustaining time period, sustaining pulse voltages having a substantially equal phase are applied to an odd-numbered scan electrode and an even-numbered sustain electrode, and sustaining pulse voltages having a substantially equal phase are applied to an even-numbered scan electrode and an odd-numbered sustain electrode.

REFERENCE MARKS IN THE DRAWINGS

| | |
|---|---|
| 21 | front substrate |
| 22 | scan electrode |
| 22a, 23a | transparent electrodes |
| 22b, 23b | metal buses |
| 22b', 23b' | projections |
| 23 | sustain electrode |
| 24 | dielectric layer |
| 25 | protective layer |
| 28 | light absorbing layer |
| 31 | back substrate |
| 32 | data electrode |
| 33 | dielectric layer |
| 34 | barrier rib |
| 34a | longitudinal wall unit |
| 34b | lateral wall unit |
| 35 | phosphor layer |
| 40 | main discharge cell |
| 41 | clearance unit (priming discharge cell) |

DETAILED DESCRIPTION OF PREFERRED EMBODIMENTS

A panel in accordance with an exemplary embodiment of the present invention will be described hereinafter with reference to the following drawings.

Figure 1:
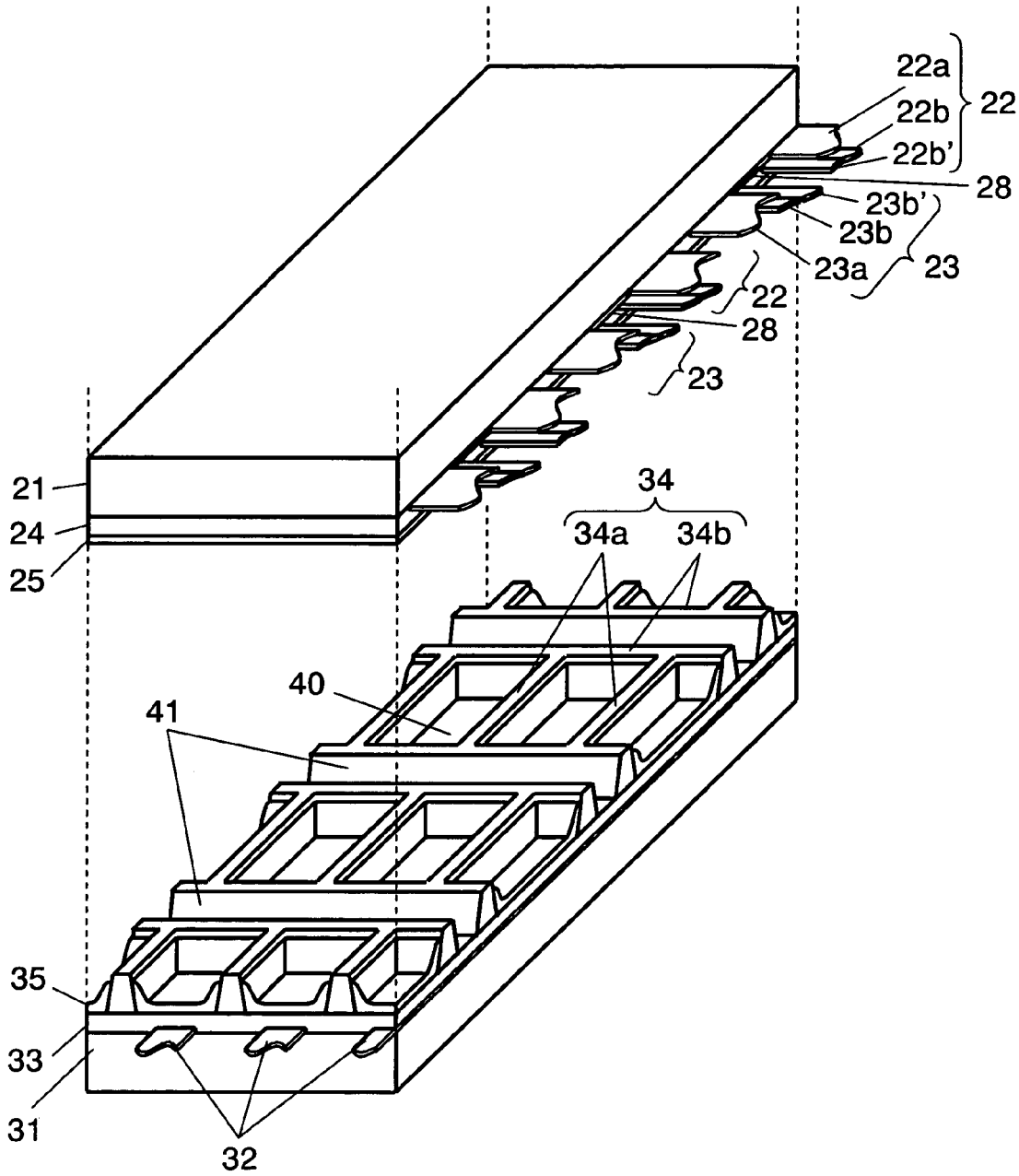
FIG. 1 is an exploded perspective view showing a configuration of a panel in accordance with an exemplary embodiment of the present invention.
Figure 2:
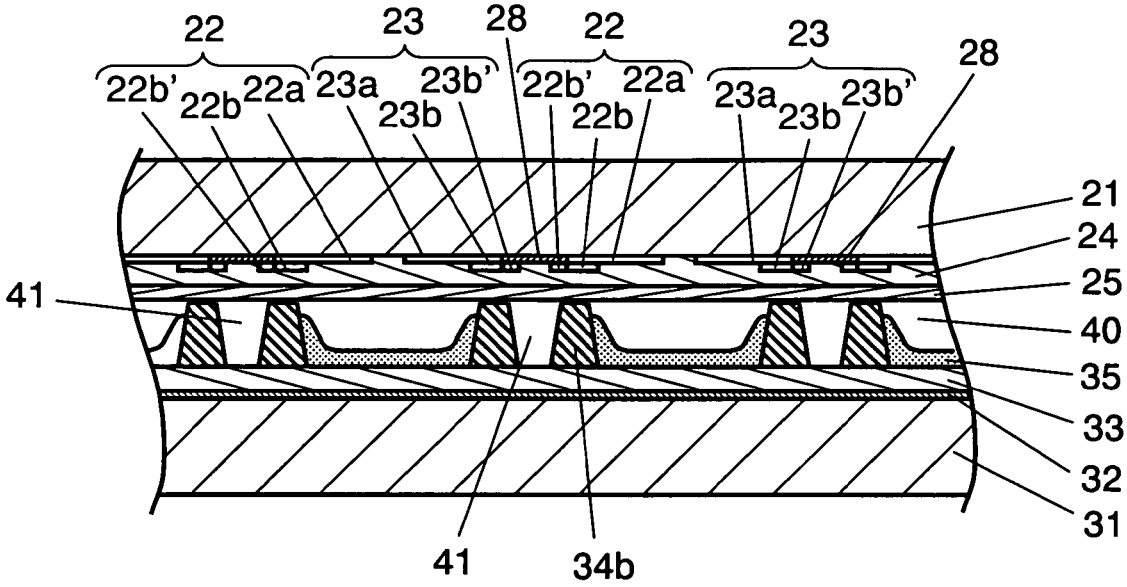
FIG. 2 is a sectional view of the panel.

FIG. 1 is an exploded perspective view showing a configuration of the panel in accordance with the exemplary embodiment of the present invention. FIG. 2 is a sectional view of the panel. Glass front substrate 21 as the first substrate and back substrate 31 as the second substrate are faced to each other on opposite sides of a discharge space, and the discharge space is filled with mixed gas of neon and xenon. The mixed gas emits ultraviolet rays with discharge.

Display electrode pairs formed of scan electrodes 22 and sustain electrodes 23 are disposed on front substrate 21 in parallel with each other. At this time, scan electrodes 22 and sustain electrodes 23 are arranged alternately so as to provide the configuration of sustain electrode 23—scan electrode 22—sustain electrode 23—scan electrode 22—and so forth. Scan electrode 22 and sustain electrode 23 are formed of transparent electrodes 22*a* and 23*a* and metal buses 22*b* and 23*b* disposed on transparent electrodes 22*a* and 23*a*, respectively. Light absorbing layer 28 made of a black material is disposed between adjacent display electrode pairs. Projections 22*b*' of metal buses 22*b* of scan electrodes 22 and projections 23*b*' of metal buses 23*b* of sustain electrodes 23 are projected beyond light absorbing layer 28. Dielectric layer 24 and protective layer 25 are formed so as to cover scan electrodes 22, sustain electrodes 23, and light absorbing layer 28.

A plurality of data electrodes 32 are formed in parallel on back substrate 31 in the intersecting direction with scan electrodes 22 and sustain electrodes 23. Dielectric layer 33 is formed so as to cover data electrodes 32. Barrier ribs 34 for separating main discharge cells 40 are formed on dielectric layer 33.

Each barrier rib 34 is formed of longitudinal wall unit 34*a* extending in parallel with data electrodes 32 and lateral wall unit 34*b* that forms main discharge cells 40 and forms clearance unit 41 between main discharge cells 40. As a result, barrier ribs 34 form a main discharge cell row having a plurality of main discharge cells 40 connected along a display electrode pair, and form clearance unit 41 between adjacent main discharge cell rows. Here, the display electrode pair is formed of a pair of scan electrode and sustain electrode, discussed above. Projection 22*b*' of scan electrode 22 and projection 23*b*' of sustain electrode 23 are formed in clearance unit 41, and clearance unit 41 works as a priming discharge cell. Clearance unit 41 is denoted with priming discharge cell 41.

Top parts of barrier ribs 34 are formed flat so as to abut on front substrate 21. This shape is employed for preventing interference between adjacent discharge cells, especially preventing a malfunction such as a writing error from being caused by the priming that is generated by writing discharge of the adjacent discharge cells in the writing time period. Further, this shape is employed for preventing a malfunction where the wall charge of main discharge cell 40 adjacent to priming discharge cell 41 decreases to cause bad writing. In the present embodiment of the present invention, the step height of barrier ribs 34 is set at 10 μm or shorter. This value is determined based on an experimental result where adjacent discharge cells 40 interfere with each other at step height over 10 μm and hence priming discharge cell 41 and discharge cell 40 interfere with each other.

Phosphor layers 35 are formed on the side surfaces of barrier ribs 34 and the surfaces of dielectric layer 33 corresponding to main discharge cells 40 separated by barrier ribs 34. Phosphor layer 35 is not formed on the priming discharge cell 41 side in FIG. 1; however, phosphor layer 35 may be formed.

Dielectric layer 33 is formed so as to cover data electrodes 32 in the above description; however, dielectric layer 33 is not necessarily required.

Figure 3:
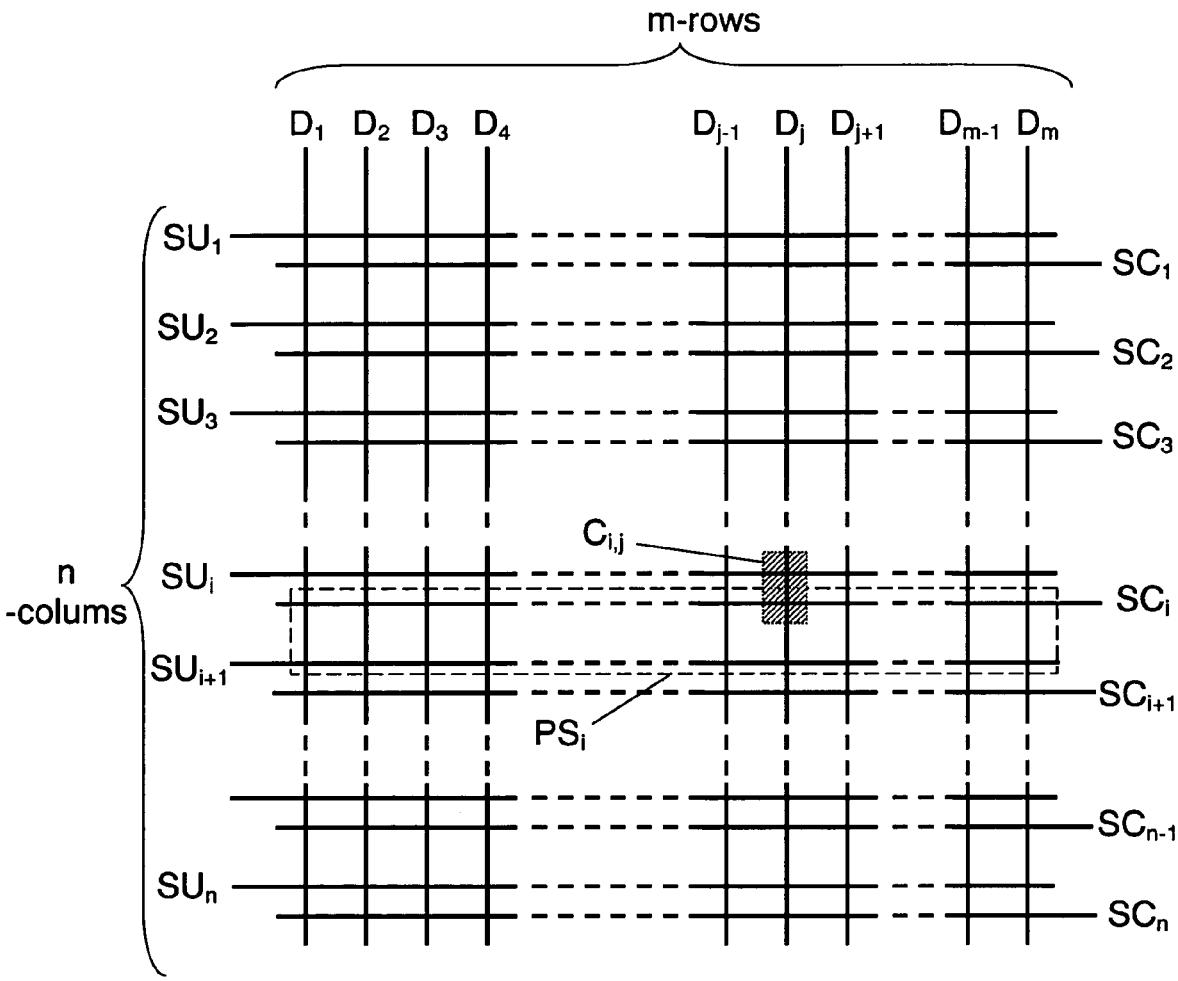
FIG. 3 is an electrode array diagram of the panel.

FIG. 3 is an electrode array diagram of the panel of the present embodiment of the present invention. In the row direction, m rows of data electrodes $D_1$ to $D_m$ (data electrodes 32 in FIG. 1) are disposed. In the column direction, n columns of scan electrodes $SC_1$ to $SC_n$ (scan electrodes 22 in FIG. 1) and n columns of sustain electrodes $SU_1$ to $SU_n$ (sustain electrodes 23 in FIG. 1) are alternately disposed so as to provide the configuration of sustain electrode $SU_1$—scan electrode $SC_1$—sustain electrode $SU_2$—scan electrode $SC_2$—and so forth. In the present embodiment of the present invention, priming discharge is performed between projections (projections 22$b'$ and 23$b'$) of adjacent scan electrode $SC_i$ (i=1 to n) and sustain electrode $SU_{i+1}$ in priming discharge cell 41.

Main discharge cell $C_{i,j}$ (main discharge cell 40 in FIG. 1) including a pair of electrodes, namely scan electrode $SC_i$ and sustain electrode $SU_i$, and one data electrode $D_j$ (j=1 to m) is formed in an m×n array in the discharge space. Priming discharge cell $PS_i$ (priming discharge cell 41 in FIG. 1) including the projection of scan electrode $SC_i$ and the projection of sustain electrode $SU_{i+1}$ is formed.

Next, a driving waveform for driving the panel, its timing, and an operation of the panel are described hereinafter.

Figure 4:
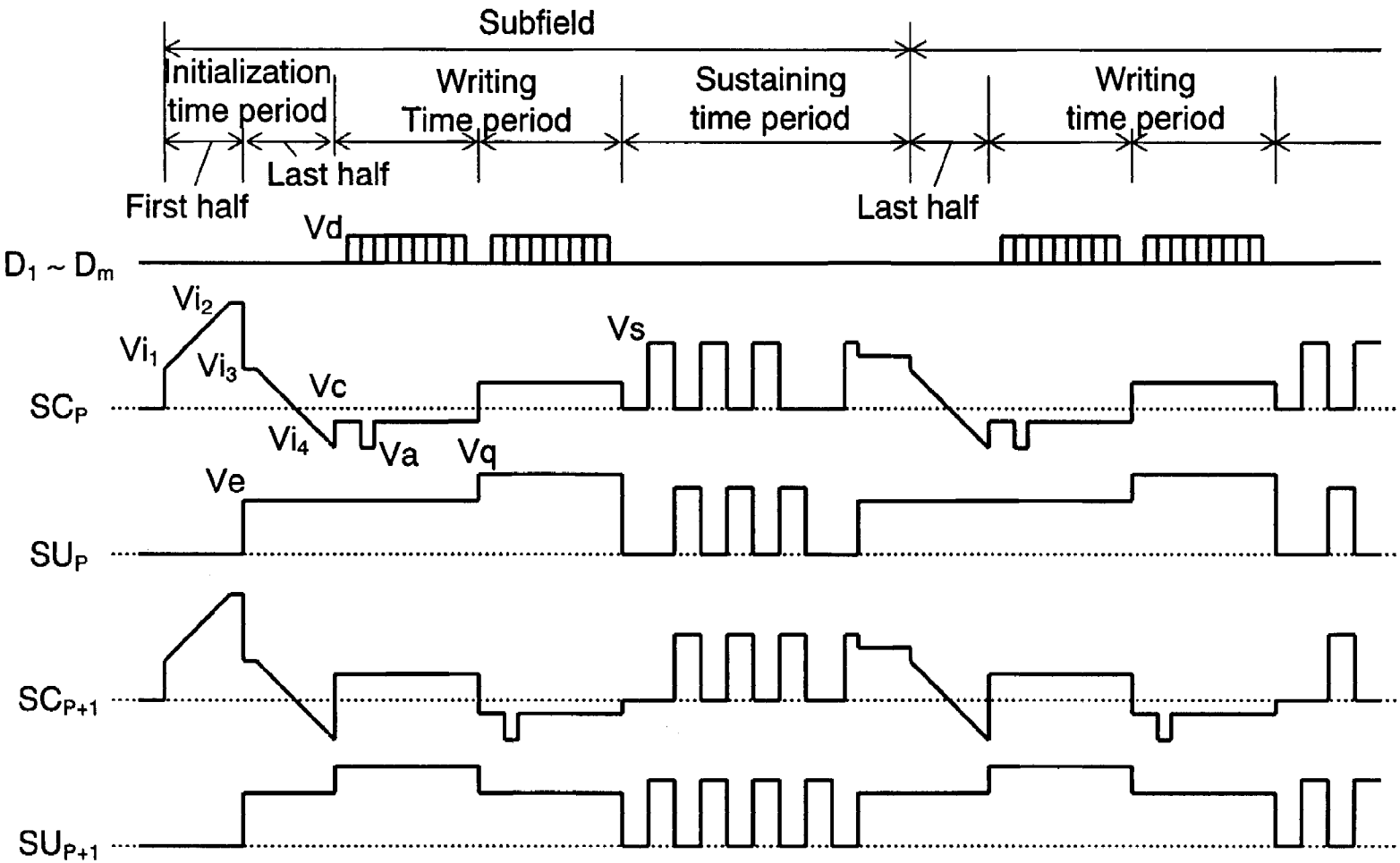
FIG. 4 is a driving waveform diagram of the panel.

FIG. 4 is a driving waveform diagram of the panel of the present embodiment of the present invention. One field time period is formed of a plurality of subfields having an initialization time period, a writing time period, and a sustaining time period in the present embodiment. The writing time period has an odd-numbered line writing time period and an even-numbered line writing time period. In the odd-numbered line writing time period, a writing operation is performed in main discharge cells having odd-numbered scan electrodes, and in the even-numbered line writing time period, a writing operation is performed in main discharge cells having even-numbered scan electrodes. The writing operations of the odd-numbered scan electrode and the even-numbered scan electrode are performed temporally separately. As described below, this operation method is employed for causing the priming discharge using the wall charge sequentially, continuously, and safely. This method can reduce influence of interaction between discharge cells, especially influence of vertically adjacent main discharge cells in the writing time period.

In the first half of the initialization time period, data electrodes $D_1$ to $D_m$ and sustain electrodes $SU_1$ to $SU_n$ are kept 0 (V), and a ramp waveform voltage gradually increasing from voltage $Vi_1$ toward voltage $Vi_2$ is applied to scan electrodes $SC_1$ to $SC_n$. Here, voltage $Vi_1$ is set so that the voltage difference between sustain electrodes $SU_1$ to $SU_n$ and scan electrodes $SC_1$ to $SC_n$ is not higher than the discharge start voltage, and voltage $Vi_2$ is set so that the voltage difference is higher than the discharge start voltage. In main discharge cell $C_{i,j}$ and priming discharge cell $PS_i$, one feeble initializing discharge occurs between scan electrodes $SC_1$ to $SC_n$ and sustain electrodes $SU_1$ to $SU_n$, and one feeble initializing discharge occurs between scan electrodes $SC_1$ to $SC_n$ and data electrodes $D_1$ to $D_m$, while the ramp waveform voltage increases. Negative wall voltage is accumulated on scan electrodes $SC_1$ to $SC_n$, and positive wall voltage is accumulated on data electrodes $D_1$ to $D_m$ and sustain electrodes $SU_1$ to $SU_n$. Here, the wall voltage on the electrodes means the voltage generated by the wall charges accumulated on the dielectric layer covering the electrodes or on the phosphor layer.

In the last half of the initialization time period, sustain electrodes $SU_1$ to $SU_n$ are kept at positive voltage Ve, and a ramp waveform voltage gradually decreasing from voltage $Vi_3$ toward voltage $Vi_4$ is applied to scan electrodes $SC_1$ to $SC_n$. Here, voltage $Vi_3$ is set so that the voltage difference between sustain electrodes $SU_1$ to $SU_n$ and scan electrodes $SC_1$ to $SC_n$ is not higher than the discharge start voltage, and voltage $Vi_4$ is set so that the voltage difference is higher than the discharge start voltage. In main discharge cell $C_{i,j}$ and priming discharge cell $PS_i$, two feeble initializing discharges occur between scan electrodes $SC_1$ to $SC_n$ and sustain electrodes $SU_1$ to $SU_n$, and two feeble initializing discharges occur between scan electrodes $SC_1$ to $SC_n$ and data electrodes $D_1$ to $D_m$, while the ramp waveform voltage decreases. The negative wall voltage on scan electrodes $SC_1$ to $SC_n$ and positive wall voltage on sustain electrodes $SU_1$ to $SU_n$ are reduced, positive wall voltage on data electrodes $D_1$ to $D_m$ is adjusted to a value suitable for the writing operation.

In the odd-numbered line writing time period, odd-numbered scan electrode $SC_p$ (p=odd number) is temporarily kept at voltage Vc. Voltage Vq is applied to even-numbered sustain electrode $SU_{p+1}$ to cause discharge in priming discharge cell $PS_p$ between sustain electrode $SU_{p+1}$ and odd-numbered scan electrode $SC_p$ adjacent to it. Next, when scan pulse voltage Va is applied to first scan electrode $SC_1$, priming discharge occurs in priming discharge cell $PS_1$ between scan electrode $SC_1$ and second sustain electrode $SU_2$, and the priming is supplied into main discharge cells $C_{1,1}$ to $C_{1,m}$. At this time, when positive writing pulse Vd is applied to data electrode $D_k$ (k is integer 1 to m) corresponding to an image signal to be displayed, discharge occurs in the intersecting part of data electrode $D_k$ and scan electrode $SC_1$ and results in discharge between sustain electrode $SU_1$ and scan electrode $SC_1$ of corresponding discharge cell $C_{1,k}$. Positive wall voltage is accumulated on scan electrode $SC_1$ in main discharge cell $C_{1,k}$, negative wall voltage is accumulated on sustain electrode $SU_1$, and the writing operation of the first row is finished. At this time, positive wall voltage is accumulated on scan electrode $SC_1$ in priming discharge cell $PS_1$, and negative wall voltage is accumulated on sustain electrode $SU_2$.

Similarly, the writing operations of odd-numbered discharge cells $C_{3,k}$, $C_{5,k}$, and so forth are performed.

In the even-numbered line writing time period, even-numbered scan electrode $SC_{p+1}$ is temporarily kept at voltage Vc. Voltage Vq is applied to odd-numbered sustain electrode $SU_{p+2}$ to cause discharge in priming discharge cell $PS_{p+1}$ between sustain electrode $SU_p$ and even-numbered scan electrode $SC_{p+1}$ adjacent to it. Next, when scan pulse voltage Va is applied to second scan electrode $SC_2$, priming discharge occurs in priming discharge cell $PS_2$ between scan electrode $SC_2$ and sustain electrode $SU_3$. The priming is supplied into main discharge cells $C_{2,1}$ to $C_{2,m}$. At this time, when positive writing pulse Vd is applied to data electrode $D_k$ corresponding to the image signal to be displayed, discharge occurs in the intersecting part of data electrode $D_k$ and scan electrode $SC_2$ and results in discharge between sustain electrode $SU_2$ and scan electrode $SC_2$ of corresponding discharge cell $C_{2,k}$. Positive wall voltage is accumulated on scan electrode $SC_2$ in main discharge cell $C_{2,k}$, negative wall voltage is accumulated on sustain electrode $SU_2$, and the writing operation of the second row is finished. At this time, positive wall voltage is accumulated on scan electrode $SC_2$ in priming discharge cell $PS_2$, and negative wall voltage is accumulated on sustain electrode $SU_3$.

Similarly, the writing operations of even-numbered discharge cells $C_{4,k}$, $C_{6,k}$, and so forth are performed. The writing time period is thus finished.

In the sustaining time period, scan electrodes $SC_1$ to $SC_n$ and sustain electrodes $SU_1$ to $SU_n$ are temporarily returned to 0 (V), and then positive sustaining pulse voltage Vs is applied to odd-numbered scan electrode $SC_p$ and even-numbered sustain electrode $SU_{p+1}$. At this time, the voltage between the upper parts of scan electrode $SC_p$ and sustain electrode $SU_p$ in main discharge cell $C_{p,k}$ having undergone writing discharge becomes larger than the discharge start voltage. That is because positive sustaining voltage Vs and the wall voltages accumulated on scan electrode $SC_p$ and sustain electrode $SU_p$ in the writing time period are added to the discharge start voltage. Thus, sustaining discharge occurs in odd-numbered main discharge cell $C_{p,k}$. Next, odd-numbered scan electrode $SC_p$ and even-numbered sustain electrode $SU_{p+1}$ are returned to 0 (V), and positive sustaining pulse voltage Vs is applied to even-numbered scan electrode $SC_{p+1}$ and odd-numbered sustain electrode $SU_p$. At this time, the voltage between the upper parts of scan electrode $SC_i$ and sustain electrode $SU_i$ in main discharge cell $C_{i,k}$ having undergone writing discharge becomes larger than the discharge start voltage. That is because positive sustaining voltage Vs and the wall voltages accumulated on scan electrode $SC_i$ and sustain electrode $SU_i$ in the writing time period are added to the discharge start voltage. Thus, sustaining discharge occurs in odd-numbered and even-numbered main discharge cells $C_{i,k}$. After that, the following operations are alternately performed:

alternately applying sustaining pulse voltage having a substantially equal phase to odd-numbered scan electrode $SC_p$ and even-numbered sustain electrode $SU_{p+1}$; and alternately applying sustaining pulse voltage having a substantially equal phase to even-numbered scan electrode $SC_{p+1}$ and odd-numbered sustain electrode $SU_p$.

Thanks to these operations, sustaining discharge is continuously repeated by the number of sustaining pulses in main discharge cell $C_{i,k}$ having undergone writing discharge.

In the ending stage of the sustaining time period, even-numbered scan electrode $SC_{p+1}$ and odd-numbered sustain electrodes $SU_p$ are returned to 0 (V), and positive sustaining pulse voltage Vs is applied only to even-numbered sustain electrode $SU_{p+1}$. At this time, sustaining discharge occurs only in main discharge cell $C_{p+1,k}$ in which writing discharge has occurred. Then, even-numbered sustain electrode $SU_{p+1}$ is returned to 0 (V), narrow sustaining pulse voltage Vs is applied to odd-numbered and even-numbered scan electrodes $SC_i$ to cause erasing discharge, and sustaining discharge is finished. At this time, the wall voltages accumulated on scan electrode $SC_i$ and sustain electrode $SU_i$ in priming discharge cell $PS_i$ are also simultaneously erased.

In the initialization time period of a subsequent subfield, sustain electrodes $SU_1$ to $SU_n$ are kept at positive voltage Ve, and a ramp waveform voltage gradually decreasing toward voltage $Vi_4$ is applied to scan electrodes $SC_1$ to $SC_n$. In main discharge cell $C_{i,k}$ where sustaining discharge has occurred, feeble initializing discharge occurs between scan electrodes $SC_1$ to $SC_n$ and sustain electrodes $SU_1$ to $SU_n$ and feeble initializing discharge occurs between scan electrodes $SC_i$ to $SC_n$ and data electrodes $D_1$ to $D_m$. The wall voltage on scan electrodes $SC_1$ to $SC_n$ and the wall voltage on sustain electrodes $SU_1$ to $SU_n$ are decreased, and the positive wall voltage on data electrodes $D_1$ to $D_m$ is adjusted to a voltage suitable for the writing operation.

Operations in the writing time period and the sustaining time period after the initialization time period, the driving waveform of a subsequent subfield, and the operation of the panel are the same as those discussed above.

Here, an operation of a priming discharge cell is especially described again. In the odd-numbered line writing time period of the subfield, negative scan pulse voltage Va is applied to odd-numbered scan electrode $SC_p$, and positive voltage Vq is applied to even-numbered sustain electrode $SU_{p+1}$, thereby causing priming discharge. Positive wall voltage is accumulated on odd-numbered scan electrode $SC_p$, and negative wall voltage is accumulated on even-numbered sustain electrode $SU_{p+1}$, in priming discharge cell $PS_p$. In the subsequent even-numbered line writing time period, negative scan pulse voltage Va is applied to even-numbered scan electrode $SC_{p+1}$, and positive voltage Vq is applied to odd-numbered sustain electrode $SU_p$, thereby causing priming discharge. Positive wall voltage is accumulated on even-numbered scan electrode $SC_{p+1}$, and negative wall voltage is accumulated on odd-numbered sustain electrode $SU_p$, in priming discharge cell $PS_{p+1}$. At the completion of the writing time period, positive wall voltage is accumulated on scan electrode $SC_n$, and negative wall voltage is accumulated on sustain electrode $SU_n$, regardless of the odd-numbered line or even-numbered line.

In the subsequent sustaining time period, when narrow sustaining pulse voltage Vs is applied to scan electrode $SC_i$, erasing discharge occurs, and the wall voltages accumulated on scan electrode $SC_i$ and sustain electrode $SU_i$ in priming discharge cell $PS_i$ are erased.

In the embodiment of the present invention, the writing time period is divided into the odd-numbered line writing time period and even-numbered line writing time period, and the priming discharge is also divided into the odd-numbered line discharge and even-numbered line discharge. Thanks to these divisions, interference between adjacent discharge cells is suppressed, and the writing discharge can be stabilized without reducing driving voltage margin of the writing operation.

Figure 5:
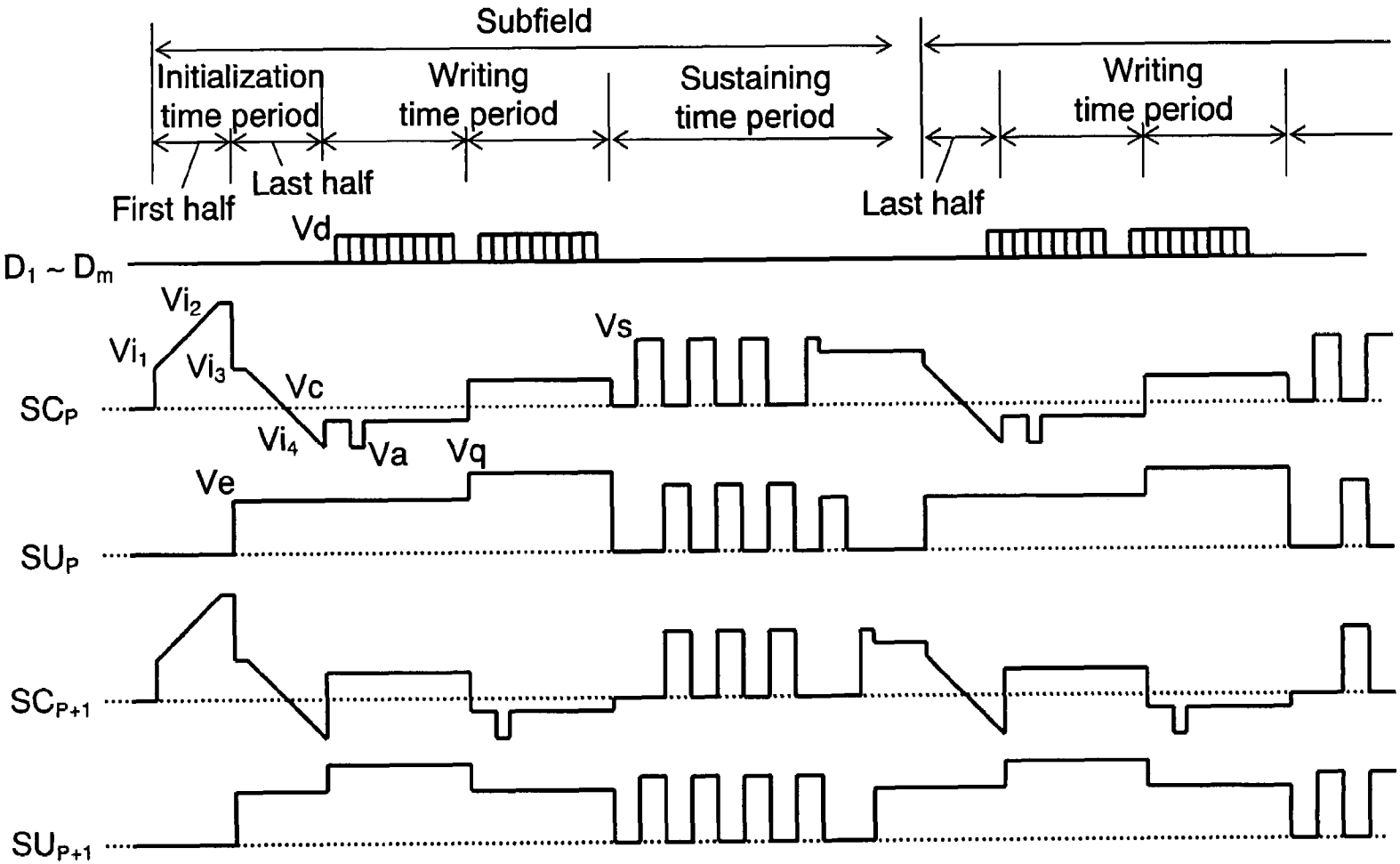
FIG. 5 is a driving waveform diagram of a panel in accordance with another exemplary embodiment of the present invention.

In the above-mentioned description of the operations, in the ending stage of the sustaining time period, narrow sustaining pulse voltage Vs is applied to odd-numbered and even-numbered scan electrodes $SC_i$ to cause erasing discharges simultaneously. However, the erasing discharges do not need to be simultaneously caused. FIG. 5 is a driving waveform diagram of a panel in accordance with another exemplary embodiment of the present invention. In the driving waveforms of FIG. 5, the erasing discharge is caused on the odd-numbered line side, and then the erasing discharge is caused on the even-numbered line side. Odd-numbered sustain electrode $SU_p$ is temporarily kept 0 (V) with an applying timing of narrow sustaining pulse voltage Vs to even-numbered scan electrode $SC_{p+1}$. This operation causes erasing discharge between even-numbered scan electrode $SC_{p+1}$ and odd-numbered sustain electrode $SU_p$ in priming discharge cell $PS_{p+1}$.

In the above-mentioned description of the operations, scan electrodes 22 and sustain electrodes 23 are arranged so as to provide the configuration of sustain electrode 23—scan electrode 22—sustain electrode 23—scan electrode 22—and so forth. However, they may be arranged so as to provide scan electrode 22—sustain electrode 23—scan electrode 22—sustain electrode 23—and so forth. In the latter case, a sustain electrode for causing priming discharge between itself and first scan electrode $SC_1$ does not exist. However, the writing operation of the first line is performed just after the initializing discharge, so that the priming discharge can be omitted.

In the above-mentioned description, in the initialization time period of the first subfield, a full cell initializing operation of performing initializing discharge in all main discharge cells is performed. In the initialization time periods of the next subfield and later, a selective initializing operation is performed where the main discharge cell having undergone sustaining discharge is selectively initialized. However, these initializing operations may be arbitrarily combined.

The present invention can provide a driving method of a plasma display panel capable of stably causing the writing discharge without reducing the driving voltage margin of the writing operation.

INDUSTRIAL APPLICABILITY

In a driving method of a panel of the present invention, writing discharge can be stably caused without reducing the driving voltage margin of the writing operation, so that this panel is useful as a plasma display panel used in a wall-mounted TV or a large monitor.

The invention claimed is:

1. A driving method of a plasma display panel, the plasma display panel comprising:

a first substrate;

a plurality of display electrode pairs that are disposed on the first substrate and formed of scan electrodes and sustain electrodes, the scan electrodes and the sustain electrodes being arranged in parallel;

a second substrate faced to the first substrate through a discharge space;

a plurality of data electrodes disposed on the second substrate and in a direction crossing the display electrode pairs; and a barrier rib disposed between the first substrate and the second substrate so as to separate main discharge cells for causing main discharge and priming discharge cells for causing priming discharge, the driving method of the plasma display panel comprising:

forming one field including a plurality of subfields having an initialization time period, a writing time period, and a sustaining time period;

dividing the writing time period into an odd-numbered line writing time period in which a writing operation is performed in the main discharge cell corresponding to an odd-numbered scan electrode, and an even-numbered line writing time period in which a writing operation is performed in the main discharge cell corresponding to an even-numbered scan electrode;

sequentially applying a scan pulse to an odd-numbered scan electrode and applying voltage to an even-numbered sustain electrode in the odd-numbered line writing time period, the voltage being used for causing priming discharge in the priming discharge cell between the even-numbered sustain electrode and the odd-numbered scan electrode to which the scan pulse has been applied;

sequentially applying a scan pulse to an even-numbered scan electrode and applying voltage to an odd-numbered sustain electrode in the even-numbered line writing time period, the voltage being used for causing priming discharge in the priming discharge cell between the odd-numbered sustain electrode and the even-numbered scan electrode to which the scan pulse has been applied; and applying sustaining pulse voltages having a substantially equal phase to an odd-numbered scan electrode and an even-numbered sustain electrode, and applying sustaining pulse voltages having a substantially equal phase to an even-numbered scan electrode and an odd-numbered sustain electrode, in the sustaining time period.

* * * * *

UNITED STATES PATENT AND TRADEMARK OFFICE

CERTIFICATE OF CORRECTION

PATENT NO. : 7,348,937 B2
APPLICATION NO. : 10/546991
DATED : March 25, 2008
INVENTOR(S) : Hiroyuki Tachibana et al.

It is certified that error appears in the above-identified patent and that said Letters Patent is hereby corrected as shown below:

ON THE TITLE PAGE

On the title page, Item (54), "Plasma Display Panel Drive Method" please change to --Method for Driving Plasma Display Panel--.

Signed and Sealed this

Second Day of September, 2008

JON W. DUDAS
*Director of the United States Patent and Trademark Office*

UNITED STATES PATENT AND TRADEMARK OFFICE

CERTIFICATE OF CORRECTION

PATENT NO. : 7,348,937 B2
APPLICATION NO. : 10/546991
DATED : March 25, 2008
INVENTOR(S) : Hiroyuki Tachibana et al.

It is certified that error appears in the above-identified patent and that said Letters Patent is hereby corrected as shown below:

ON THE TITLE PAGE

On the title page, Item (54), and Column 1, line 1, "Plasma Display Panel Drive Method" please change to --Method for Driving Plasma Display Panel--.

This certificate supersedes the Certificate of Correction issued September 2, 2008.

Signed and Sealed this

Thirtieth Day of September, 2008

JON W. DUDAS
*Director of the United States Patent and Trademark Office*